US009127399B2

(12) United States Patent
Chatot et al.

(10) Patent No.: US 9,127,399 B2
(45) Date of Patent: Sep. 8, 2015

(54) DOMESTIC APPLIANCE HAVING A FIRE PREVENTION MEDIUM

(75) Inventors: Brian Chatot, Saint Joseph, MI (US); Frank Kohlrusch, Berlin (DE); Günter Steffens, Dallgow-Döberitz (DE)

(73) Assignee: BSH Hausgeräte GmbH, Munich (DE)

( * ) Notice: Subject to any disclaimer, the term of this patent is extended or adjusted under 35 U.S.C. 154(b) by 395 days.

(21) Appl. No.: 13/696,102

(22) PCT Filed: May 5, 2011

(86) PCT No.: PCT/EP2011/057174

§ 371 (c)(1), (2), (4) Date: Nov. 5, 2012

(87) PCT Pub. No.: WO2011/138383

PCT Pub. Date: Nov. 10, 2011

(65) Prior Publication Data

US 2013/0056231 A1 Mar. 7, 2013

(30) Foreign Application Priority Data

May 7, 2010 (DE) ..... 10 2010 028 778

(51) Int. Cl.
*F26B 11/06* (2006.01)
*D06F 37/42* (2006.01)

(52) U.S. Cl.
CPC ..... *D06F 37/42* (2013.01)

(58) Field of Classification Search
CPC ..... F26B 11/06; F26B 19/00; D06F 58/00; D06F 58/20; D06F 58/26; D06F 58/28; A26C 3/00; A26C 3/006
USPC ..... 34/595, 601, 610; 68/5 C, 5 R, 19, 20; 8/132, 149
See application file for complete search history.

(56) References Cited

U.S. PATENT DOCUMENTS 4,830,116 A * 5/1989 Walden et al. ..... 169/65
4,979,572 A * 12/1990 Mikulec ..... 169/65
5,153,055 A * 10/1992 Ko ..... 442/232
5,197,203 A * 3/1993 Lenoir ..... 34/90
5,351,760 A * 10/1994 Tabor, Jr. ..... 169/65

(Continued)

FOREIGN PATENT DOCUMENTS

DE 3024738 A1 10/1982
DE 19601525 A1 * 4/1997 ..... A62C 25/00

(Continued)

OTHER PUBLICATIONS

International Search Report PCT/EP2011/057174, Aug. 2011.
National Search Report DeE 10 2010 028 778.4, Nov. 26, 2010.

*Primary Examiner* — Stephen M Gravini
(74) *Attorney, Agent, or Firm* — Jordan IP Law, LLC; Todd A. Vaughn

(57) ABSTRACT

An electrical domestic appliance includes a fire-prevention medium for fighting a fire in the domestic appliance in an early stage. The fire-prevention medium includes an active substance, which releases water, carbon dioxide and/or nitrogen under the effect of heat at a temperature below 100° C. The fire-prevention medium has a core, which contains the active substance and a carrier material, and a shell, which surrounds the core.

20 Claims, 4 Drawing Sheets

(56) References Cited

U.S. PATENT DOCUMENTS

| | | | | |
|---|---|---|---|---|
| 5,606,804 | A * | 3/1997 | Smith et al. | 34/261 |
| 5,718,062 | A * | 2/1998 | de Vroome | 34/494 |
| 5,936,531 | A * | 8/1999 | Powers | 340/628 |
| 6,104,301 | A * | 8/2000 | Golden | 340/628 |
| 6,521,689 | B1 | 2/2003 | Yabuhara et al. | |
| 6,648,077 | B2 * | 11/2003 | Hoffman | 169/56 |
| 6,655,047 | B2 * | 12/2003 | Miller, II | 34/544 |
| 7,231,988 | B2 * | 6/2007 | Jerg et al. | 169/60 |
| 7,445,052 | B2 * | 11/2008 | Jerg | 169/60 |
| 2013/0056231 | A1 * | 3/2013 | Chatot et al. | 169/70 |
| 2013/0174441 | A1 * | 7/2013 | Grunert et al. | 34/524 |

FOREIGN PATENT DOCUMENTS

| | | | | |
|---|---|---|---|---|
| EP | 0716194 | B1 | 11/2002 | |
| EP | 2072659 | A1 * | 6/2009 | D06F 58/28 |
| GB | 1335932 | | 10/1973 | |
| GB | 1385859 | A * | 3/1975 | |
| GB | 2296322 | A | 6/1996 | |
| JP | 57140351 | A | 8/1982 | |
| JP | 2001212396 | A | 8/2001 | |
| WO | 2006069411 | A1 | 7/2006 | |
| WO | 2009106347 | A1 | 9/2009 | |
| WO | WO 2011138383 | A1 * | 11/2011 | |

* cited by examiner

DOMESTIC APPLIANCE HAVING A FIRE PREVENTION MEDIUM

BACKGROUND OF THE INVENTION

The invention relates to a domestic appliance having a fire prevention medium.

Under some circumstances an electrical domestic appliance can represent a potential source of a fire. Typical causes of a fire in this context can be contact faults for example (e.g. loose contacts in electrical power outlets or appliances) and disproportionate amounts of useful heat generated in an appliance operated unsupervised such as an electric cooker, dryer or a washing machine. A control and regulation device of a domestic appliance can also fail, in which case dangerously high temperatures can arise at the domestic appliance involved. Finally a fire can arise as a result of overloading of a mains power network by connecting too many domestic appliances thereto.

Device-specific properties can increase the principle danger of a fire. This particularly applies to electrical domestic appliances which heat up significantly during operation. With ovens, dryers and washing machines in particular fires can therefore often occur as a result of increased temperatures.

These possible causes of fires are to be seen against the background of the increasing use of plastics in domestic appliances. Plastics can actually principally be equipped to inhibit fires. However the substances used for such purposes, because of their possible or actual risk to health, are in fact rarely used in domestic appliances.

JP 57-140351 A describes fire protection materials made of gypsum and alum which are stabilized with fibers.

DE 30 24 738 A1 describes an endothermic component designed for fire protection which is embodied as a plate. The component has a gypsum matrix as a carrier material into which aluminum sulfate is incorporated as a hydrophilic adsorbent and which is stabilized by fibers. Glass fiber in particular is used for stabilization.

GB 2 296 322 A discloses a ventilation device for a cooker which can be provided with means for fire protection. This means includes fire extinction devices which are to be activated in the event of excessive heat in the ventilation device. In addition a fire protection cabinet or a fire protection table can be provided with an appropriate fire protection system.

DE 20 25 351 A1 discloses a protective shell for cables or leads, which is designed to keep these cables or leads operable for the longest possible time in the event of a fire or similar heat effect. To this end the cables or leads are provided with a shell made of heat-resistant or fire-proof material which holds the inner layers of the cables or leads firmly together when they are affected by heat. The shell can contain layers of fiber material to which substances, especially alum, are added, which react while consuming heat, even at low temperatures.

Manufacturing of an endothermic coating made of potassium, alum and gypsum which is water-hardenable and can be applied to components such as walls as a fire-protection coating is known from JP 54-143437.

DE 600 11 058 T2 describes a flame-retardant aromatic polyamide resin compound and an object formed therefrom, which is used for example for electrical domestic appliances and electrical systems such as washing machines, refrigerators etc. The flame retardant polyamide resin compound comprises an aromatic polyamide resin, a cross-linked phosphaze compound, an organic fiber-like substance and magnesium hydroxide.

AT 501 586 A1 describes a molding compound, consisting of particles coated with a coating mass, and its use for manufacturing molded bodies. The coating masses contain a binding means, a substance with a hardening effect, a gas-developing, foam-forming substance and possibly anorganic powdered fillers and if necessary water-binding substances. If necessary anorganic crushed fillers can be included, wherein for example aluminum sulfate hydrate and alums are specified. As well as use in the building industry, use as a damping material in domestic appliances such as refrigerators, dishwashers or for installation in ovens and heating systems for industry, commerce and households is described.

JP 2001-212396 A describes a washing machine with a drum which has improved safety. To this end the washing machine has a shielding plate under the top cover plate which is formed from a fireproof part made of metal and a melamine resin.

Against this background, the object of the invention is to provide an electric domestic appliance with improved fire protection. The domestic appliance should especially make it possible to extinguish a fire which has already started or at least significantly delay its spread.

BRIEF SUMMARY OF THE INVENTION

The object underlying the invention is achieved by an electrical domestic appliance in accordance with the independent claim. Preferred embodiments of the invention are listed in the dependent claims.

The invention thus relates to an electrical domestic appliance (also shortened to "appliance" herein) with a fire protection medium, for fighting a fire in the domestic appliance its early stages, comprising an active substance which, under the effect of heat at temperatures below 100° C., releases water, carbon dioxide and/or nitrogen, in such cases, the fire prevention medium comprises a core and a shell, wherein the core contains the active substance and a carrier material and the shell surrounds the core.

The active substance used releases water, carbon dioxide and/or nitrogen at temperatures below 100° C. This makes it possible to fight a fire in its initial stage.

It is also preferable for the active substance to release water. When affected by the fire the active substance is then dehydrated. Energy is consumed during the dehydration and evaporation of water. In addition the progress of the fire is delayed by the curtain of steam which forms between the fire and its environment.

The active substance is preferably a hydrate and is selected from the group consisting of alum, zeolite, gypsum or any given combinations thereof.

A hydrate in this case is to be understood as a fixed, especially crystalline substance, which as well as the especially salt-type compound or composition of ions that generally gives it its name, contains linked water in its fixed structure. A typical example for a hydrate is a salt crystal, of which the crystal structure contains additional water molecules as well as anions and cations—such crystalline-bound water is generally referred to as "crystal water". The binding of the crystal water in the crystal is as a rule rather loose, so that more or less strong heating leads to the crystal water being driven out of the crystal.

Quite especially preferably the active substance comprises an alum. An alum is a double salt crystallized with crystal water of type $Me(1+)Me(3+)(SO_4)_2$, wherein Me(1+) preferably stands for Na, K and $NH_4$, particularly especially preferably for K, and Me(3+) stands for Al, Sc, V, Cr, Mn, Fe, Co, Ga, particularly especially preferably for Al. An alum has the advantage that it releases water even at temperatures below 100° C. and, in relation to its weight, can store a high proportion of crystal water.

It is especially advantageous to use potassium-alum. Potassium-alum, to be referred to chemically as potasium-aluminum-sulfate-12-hydrate, has the chemical formula $KAl(SO_4)_2 \times 12H_2O$. Potassium-alum is able to bind in appr. 45 percent crystal water per unit of weight, wherein the release of the crystal water from the potassium-alum in pure form occurs at 73° C. As a result of the density of the potassium-alum of 1.1 g/cm$^3$ a proportion of stored crystal water of appr. 50 percent in relation to volume is produced.

Gypsum is a calcium sulfate crystallized with two molecules of crystal water per combination of one anion and one cation, having the chemical formula $CaSO_4 \times 2H_2O$.

A zeolite is a hydrate having the general composition $Mk/n[(AlO_2)k(SiO_2)1] \times mH_2O$, wherein k, l, m and n are small whole numbers and M is any given metal ion having a charge n (mostly 1 or 2). A zeolite can especially take up and release water while retaining its crystal structure.

An alum and in particular potassium-alum is also able to be combined with other active substances such as gypsum and zeolite, which can respectively also be used on their own or in combination with other active substances.

This enables the technical properties of the fire-prevention medium to be tailored to the domestic appliance, a usage location localized therein and the usage temperature of the domestic appliance. This tailoring is illustrated below by way of example on the basis of a mixture of potassium-alum and gypsum.

Potassium-alum can be used in a fire-prevention medium together with gypsum, e.g. potassium-alum in a gypsum matrix, if necessary together with other substances. Such a use is particularly suitable when the fire-prevention medium is a relatively rigid molded part, e.g. a plastic molded part. The active substance can be distributed here homogenously or inhomogeneously in the plastic molded part and/or advantageously placed in chambers which are embodied as a core in the plastic molded part.

The potassium-alum embedded in a gypsum matrix behaves neutrally as regards the hardening (setting) of the gypsum, so that molded parts manufactured from the mixture, especially when a carrier material is used such as a stabilizing fabric for example, with simple manufacture have an adequate stability for their use in fire prevention in a domestic appliance.

The gypsum in its turn is also not adversely affected by the physical water take-up of the alum. Depending on the purpose and place of use, the mixture ratio between alum and gypsum can be varied. Since the gypsum and also the alum have a density of 1.1 g/cm$^3$, this ratio is related to weight and also to volume.

The water-release temperature of the potassium-alum of 73° C. is shifted in combination with the gypsum to a higher value, namely around 85° C. This is connected with the fact that the water becoming free in alum is held at a temperature of 85° C. by simply being sucked up by the gypsum before it is transferred into the vapor phase. Thus, by mixing potassium-alum and gypsum, a water release temperature can be set which is that is suitably removed from a usage temperature of the domestic appliance.

Fire-prevention media which contain alum and gypsum also have the further advantage that crystal water bound into the gypsum will not be released until at a temperature of 125° C., so that a multi-stage crystal water release can have a positive influence on the fire-prevention behavior.

The active substance can be used on its own or in a mixture with other active substances, especially with alum and/or gypsum, zeolite.

Zeolites have a relatively high water take-up capability and can bind the water physically as crystal water. Zeolites, depending on their type, bind around 30% crystal water in relation to their mass and again in relation to their mass release 20 to 24% of water in a temperature range of 150 to 160° C.

In the inventive domestic appliance the fire-prevention medium comprises a core and a shell, wherein the core contains the active substance. In addition a fiber fabric or a fiber fleece or a combination of these two is preferably present in the core.

In a preferred embodiment for this purpose the fire-prevention medium comprises a plastic molded part as the shell and the active substance as the core which is contained in one or more chambers disposed in the plastic molded part. The plastic molded part can be disposed at any given point in the domestic appliance and for example be used to fill unused cavities. Preferably the plastic molded part is used as cladding of a part of the domestic appliance particularly at risk from fire, e.g. as cladding of a heater or of a motor.

If, in accordance with the invention, a heater is to be surrounded with a fire-prevention medium, it should be ensured through the arrangement and the spacing of the fire-prevention medium that, when the heater is operating normally, the fire-prevention medium is not activated to release water, carbon monoxide and/or nitrogen.

If a domestic appliance is a washing machine, a washer/dryer or a tumble dryer, the fire-prevention medium can advantageously be an agitator for the laundry to be handled in the domestic appliance but can also be integrated into an agitator.

In an alternative embodiment of the inventive domestic appliance the fire-prevention medium as the shell comprises a foil, a fiber fabric or a fiber fleece, wherein these can also be combined in a given way, and whereby the shell encapsulates the actual active substance. In this case too the active substance can be contained in one or more chambers.

The material of the foil is not especially restricted. Preferably a material is used that melts at the temperature provided for the action of the fire-prevention medium to make it possible for the active substance to release water, carbon dioxide and/or nitrogen into the surroundings of the fire-prevention medium. A suitable foil comprises or typically consists of PET (polyethylene terephthalate), PE (polyethylene) or their mixtures.

For the fiber fabrics and fiber fleeces the selection of fibers is not significantly restricted. For example glass fibers, plastic fibers and metal threads can be used. Advantageously however fiber fabrics and fiber fleeces also contribute to fire prevention. When the fiber fabrics and fiber fleeces made of plastic fibers are used, fire-retardant fibers are thus preferably employed.

Fire retardant plastic fibers typically consist of polybenzimidazole, polyimide, polyetherketone, polyether-etherketone, polyetherketone-ketone, polyether-etherketone-ketone, polyetherimide, polysulfone, polyaryletherketone, polyamide-imide, polyarylsulfone, polyethersulfone, polyketone, polyphenylene sulfide or a polyaramide, or mixtures of these.

The fire-prevention medium in the inventive domestic appliance comprises a carrier material. The carrier material is disposed in a core surrounded by a shell. The term "carrier material" is thus based on the fact that this especially serves to accommodate and as a support for the one active substance or a number of active substances. The carrier material preferably contains fibers or consists of these, wherein the fibers are generally present as fabric or fleece material. The fibers can be glass fibers or plastic fibers. The choice of plastic fibers is not restricted. Preferably however fibers from one of the above-mentioned fire-retardant plastics are employed.

The fire-prevention medium can be obtained in very different ways, wherein the methods for manufacturing it generally depend on the choice of the active substances, of the carrier material and also on the desired properties of the fire-prevention medium, which in their turn depend on whereabouts in the domestic appliance it is used.

If for example alum is used as the active substance, this can be mixed together with gypsum and then unlinked from the gypsum.

Preferably however the fire-prevention medium is obtainable in the domestic appliance by soaking the carrier material with a solution of the active substance, generally followed by drying. Advantageously the solution of the active substance is an aqueous solution of alum, especially potassium-alum.

When a flexible carrier material is used, e.g. a flexible fabric or fleece material, a flexible fire-prevention medium can be obtained which can be used for example in the domestic appliance in the form of fire-prevention mats or pillows. Because of their flexibility, these fire-prevention media can then be adapted to the spatial requirements in the domestic appliance.

In an especially preferred embodiment of the inventive domestic appliance the fire-prevention medium features a closure at which the water, carbon dioxide and/or nitrogen can preferably escape. The term "closure" is to be broadly interpreted here. Thus the closure can be a comparatively weak area within the shell around the core, which, when the fire-prevention medium is heated up, gives way especially easily, as a sort of intended break point, so that the water, carbon dioxide and/or nitrogen released from the active substance can escape from the fire-prevention medium at this preferred point. Arrangement, size and type of closure will thus generally depend very much on the location where they are used and the type of selected materials. For example the closure can exist in a comparatively thin or porous area of the shell. If necessary the closure can consist of a material which differs compared to the material of the rest of the shell. Thus the active substance which might be located on a carrier material could in principle be surrounded by a plastic film made of a specific material (for example a polyethylene film of a specific thickness) as a pocket, which has an opening at a point intended for the closure. The opening could be closed off with a thinner or porous polyethylene film, a thin layer of a protective wax etc. as a closure, to facilitate the passage of water, carbon dioxide and/or nitrogen at this point.

The domestic appliance is not restricted in accordance with the invention, since in principle any electrical domestic appliance (including televisions etc.) can catch fire. Devices with integrated heating devices are preferable. In accordance with the invention it is especially preferable in this case for the domestic appliance to be a dryer, a washer/dryer, a fan heater, a washing machine or an oven.

Particularly preferably the inventive domestic appliance is a dryer or a washer/dryer. In this embodiment it is once again preferred for at least one process air duct, a heater or a motor of the dryer or washer dryer to be at least partly surrounded by the fire-prevention medium.

The amount of active substance employed in the fire-prevention medium can vary widely. In general the aim is to have the highest possible proportion of the active substance, provided certain desired properties of the fire-prevention medium can be set.

In a preferred embodiment of the invention, in which the electrical domestic appliance is a dryer or washer/dryer equipped with a drum ("washing drum"), the fire-prevention medium is located between the drum and components of the domestic appliance disposed on a base plate. In general at least one fan, a drive motor and, if the heat exchanger is present in the dryer or washer/dryer, a heat exchanger are disposed on the base plate.

The invention has the advantage that a domestic appliance with improved fire protection is provided. The domestic appliance especially makes it possible to extinguish fires that have already occurred or to at least significantly delay the spread of said fires. This is possible without use of sensors and without active mechanical or electromechanical elements.

BRIEF DESCRIPTION OF THE DRAWINGS

The invention is illustrated below with reference to FIGS. 1 to 4, wherein three non-restrictive exemplary embodiments are shown in FIGS. 1, 2 and 4.

DETAILED DESCRIPTION OF EXEMPLARY EMBODIMENTS OF THE PRESENT INVENTION

Figure 1:
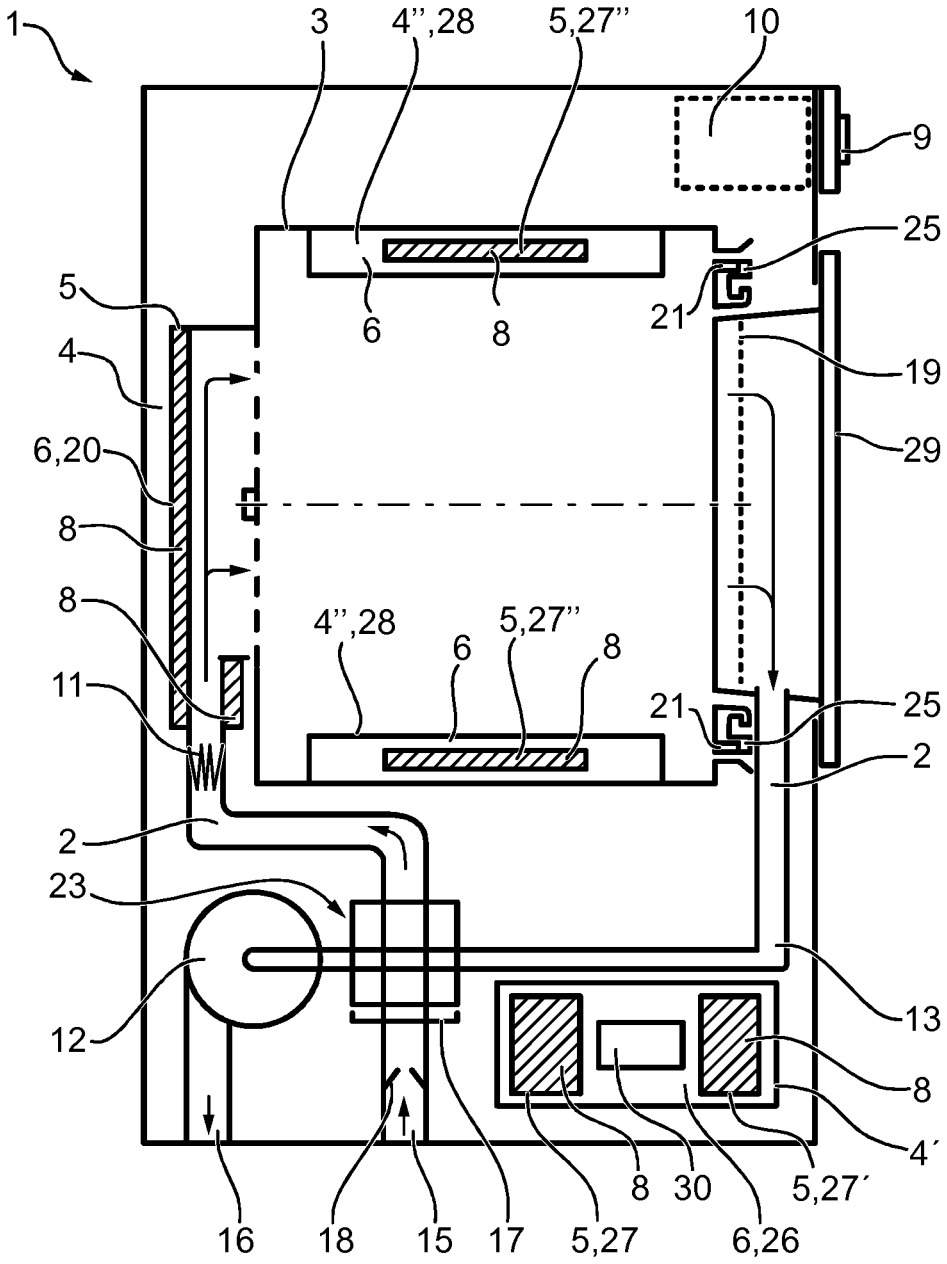
FIG. 1 shows a vertical section through a domestic appliance which is designed in accordance with a first embodiment as a tumble dryer in which heat is recovered by means of an air-air heat exchanger.

In accordance with a first embodiment, the tumble dryer 1 shown in FIG. 1 has a drum rotatable around a horizontal axis as a drying chamber 3, within which agitators 28 for moving washing—not shown here—during a drum rotation are attached. Process air is routed by means of a fan 12 over a heater 11 through the drum 3 in a process air duct 2. The process air duct 2 is supplied with room air via an inlet air duct 15 or air is sucked in by the fan 12. The air heated up by the heater 11 is conveyed from the rear, i.e. from the side of the drum 3 opposite a door 29, through the perforated base into the drum 3, comes into contact there with the washing to be dried and flows through the filling opening of the drum 3 to a lint filter 19 within the door 29 closing off the filler opening. After its passage through the drum 3 the process air flow is diverted downwards in the door 29. The moist warm process air passes from the drum 3 as an exhaust air flow into an exhaust air duct 13. Located in the exhaust air duct 13 is an air-air heat exchanger 23, in which the warm process air laden with moisture (here exhaust air) is cooled and after condensation of the moisture contained therein, is routed to the exhaust air outlet 16. The separated moisture is caught in a condensate tray 17, from where it can be removed by pumping it away for example.

For cooling, room air supplied to the tumble dryer 1 via the inlet air duct 15 is used in the air-air heat exchanger 23. This inlet air is heated by the warm, moisture-laden process air and subsequently heated up again by means of the heater 11 before entering the drying chamber 3. The inlet air can be regulated by a controllable closure device 18 (for example a flap).

Because of the air flows described, a fire arising in the tumble dryer 1 can in principle spread rapidly. As a countermeasure three fire-prevention media 4, 4' and 4" are present in the embodiment of a domestic appliance shown in FIG. 1.

Fire-prevention medium 4 is used here as cladding of an area of the process air duct 2 between the heater 11 and the drum 3. The fire-protection medium 4 here is a flexible mat which follows the windings of the process air duct 2, and comprises a core 5, which has a glass fiber which cannot be seen in any greater detail here, which after immersion in an aqueous solution of potassium-alum and drying, has been put into a polythene pocket 20 as the shell 6.

The second fire-prevention medium 4' on the other hand, in the embodiment shown here, comprises a plastic molded part 26 as the shell 6, in which two chambers, 27 and 27' are present as the core 5 to accommodate active substance 8. The fire-prevention medium 4' serves here as encapsulation for a drive motor 30 of tumble dryer 1 as a further potential source of fire.

The third fire-prevention medium 4" is embodied here as an agitator (washing agitator) 28 which has a plastic molded part as its shell 6 in which a chamber 27" as core 5 for accommodating active substance 8 is present. The fire-prevention medium 4" is especially suited to avoiding or fighting fires in the drum 3.

The drum 3, in the embodiments shown in FIG. 1, is supported at the back of the base by means of a rotary bearing and at the front by means of an end shield 25, wherein the drum 3 rests on the end shield 25 with a cramp on a slide strip 21 and is held in this way at its front end. The dryer is controlled via a control device 10, which is regulated by the user via an operating unit 9.

Figure 2:
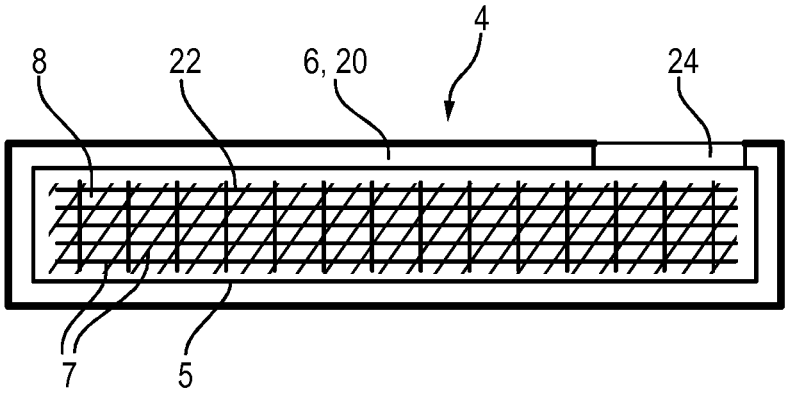
FIG. 2 shows a vertical section through a fire-prevention medium, as is used in a second embodiment of the domestic appliance.

FIG. 2 shows a vertical section through a fire-prevention medium 4, as is used in a second embodiment of the domestic appliance. The fire-prevention medium 4 is embodied here as a mat or as a pillow in that it features a core 5, in which are located a fabric 22 formed from fibers 7, here especially fire-retardant plastic fibers and also potassium-alum as the active substance 8. The core 5 is surrounded by a shell 6, which is a polyethylene foil 20 here. This foil is modified at an outlet 24 by being thinner or by consisting of a material which is weaker or more permeable in some way, so that when the fire-protection medium 4 is heated up, water released from the active substance 8 can preferably escape from the fire-protection medium 4 at this point.

Figure 3:
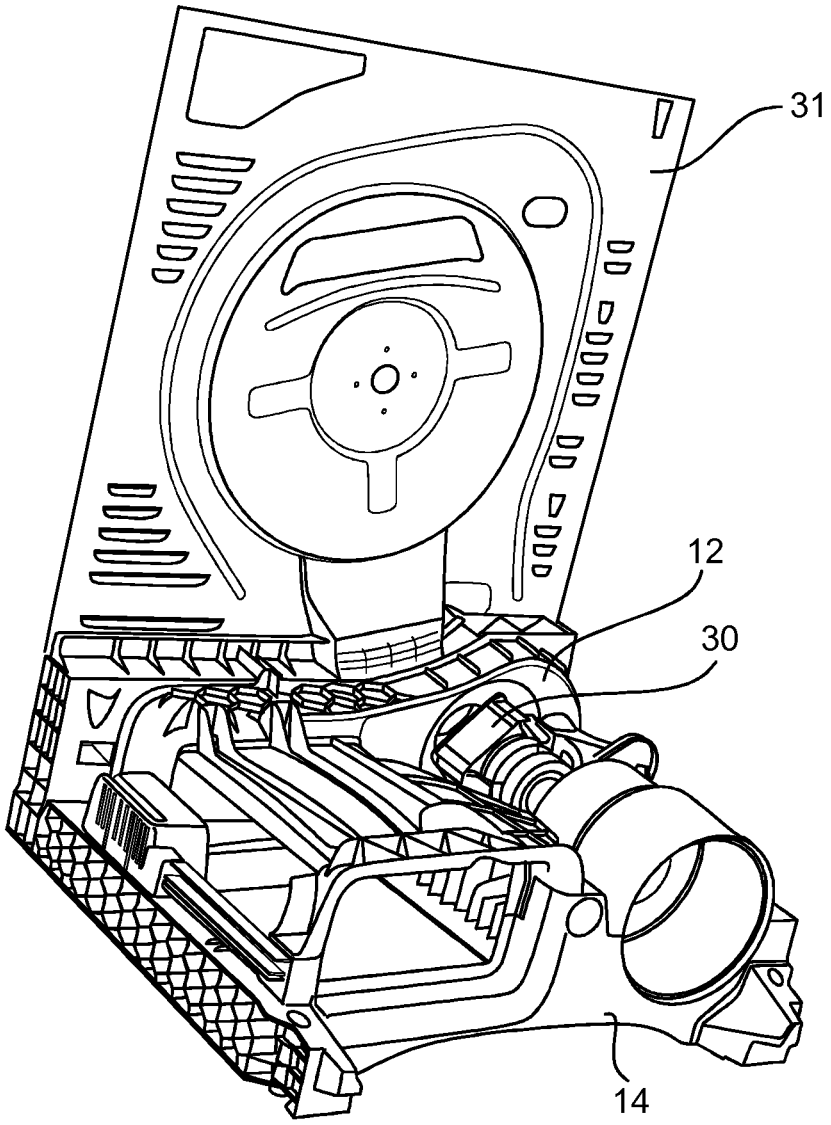
FIG. 3 shows a perspective view of a part of a known tumble dryer.

FIG. 3 shows a perspective view of a part of a known tumble dryer. For the sake of clarity drum and heater are omitted from this diagram for example. Disposed on a base plate 14 here are different components of the tumble dryer, e.g. a fan 12 and a drive motor 30. The number 31 identifies a rear wall of the tumble dryer.

Figure 4:
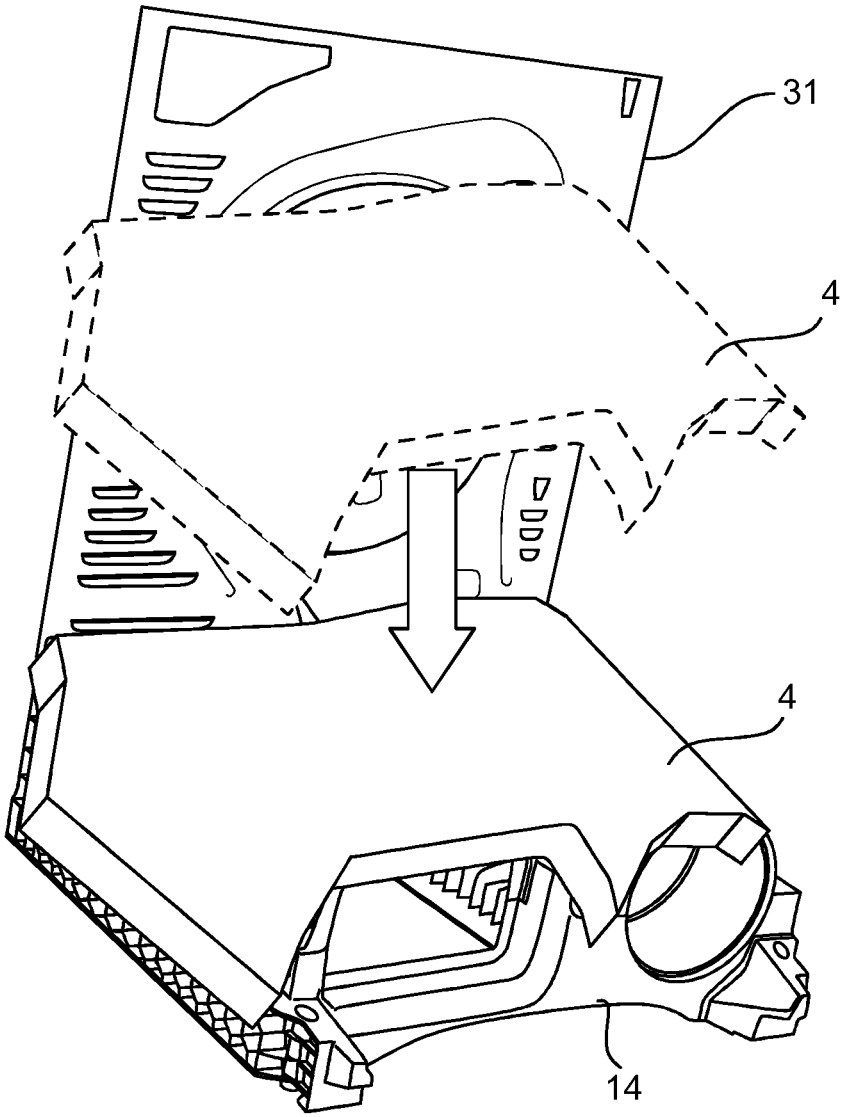
FIG. 4 shows a perspective view of a part of an inventive tumble dryer as a third embodiment of the domestic appliance.

FIG. 4 shows a perspective view of a part of the inventive tumble dryer as a third embodiment of the domestic appliance. By contrast with the known dryer from FIG. 3, a fire-prevention medium 4 is placed on the components disposed on the base plate 14. Shell and core of fire-prevention medium 4 are not shown in detail here. As can be easily seen, the fire-prevention medium 4 is located in the third embodiment of the domestic appliance between the drum not shown here and the components of the domestic appliance disposed on the base plate 14. As in FIG. 3 different components of a tumble dryer are disposed on the base plate 14, e.g. a fan 12 and a drive motor 30. The number 31 identifies a rear wall of the tumble dryer.

LIST OF REFERENCE CHARACTERS

1 Domestic appliance
2 Process air duct
3 Drum
4, 4', 4" Fire-prevention media
5 Core
6 Shell
7 Fibers
8 Active substance
9 Operating unit
10 Control device
11 Heater
12 Fan
13 Exhaust air duct
14 Base plate
15 Inlet air duct
16 Waste air outlet
17 Condensate tray
18 controllable closure facility, flap
19 Lint grating
20 Plastic foil or fabric as shell
21 Slide strip
22 Fabric as core
23 Air-air heat exchanger
24 Output
25 End shield
26 Plastic molded part
27, 27', 27" Chambers
28 Agitators
29 Tumble dryer door
30 Drive motor
31 Tumble dryer rear wall

The invention claimed is:

1. A domestic appliance, comprising:

a housing having a process air duct, a heater, and a motor arranged therein; and a fire-prevention medium which at least partly surrounds at least one of the process air duct, the heater and the motor to extinguish or prevent a spread of a fire in the housing, the fire-prevention medium including a core, a carrier material arranged in the core, a shell which surrounds the core, and an active substance contained in the core which releases at least one member selected from the group consisting of water, carbon dioxide and nitrogen under the effect of heat at a temperature below 100° C.

2. The domestic appliance of claim 1, wherein the active substance comprises alum.

3. The domestic appliance of claim 1, wherein the active substance comprises a hydrate.

4. The domestic appliance of claim 3, wherein the hydrate is selected from the group consisting of alum, zeolite, gypsum, and any combination thereof.

5. The domestic appliance of claim 1, wherein the shell comprises a plastic molded part.

6. The domestic appliance of claim 5, wherein the core comprises at least one chamber disposed in the plastic molded part.

7. The domestic appliance of claim 1, wherein the shell comprises a foil, a fiber fabric, a fiber fleece, or a combination thereof.

8. The domestic appliance of claim 1, wherein the carrier material comprises fibers.

9. The domestic appliance of claim 1, wherein the carrier material is soaked with a solution of the active substance.

10. The domestic appliance of claim 9, wherein the solution comprises an aqueous solution of alum.

11. The domestic appliance of claim 1, wherein the fire-prevention medium comprises an outlet to allow an escape of the at least one member.

12. The domestic appliance of claim 1, wherein the domestic appliance comprises one of a tumble dryer, a washer/dryer, a washing machine, or an oven.

13. A domestic appliance, comprising:

a drum;

a process air duct;

a heater;

a motor; and a plurality of fire-prevention media to extinguish or prevent a spread of a fire in the domestic appliance, a respective one of the fire-prevention media arranged at the drum, the process air duct, the heater, and the motor, respectively, the fire-prevention media including a core, a carrier material arranged in the core, a shell which surrounds the core, and an active substance contained in the core which releases at least one member selected from the group consisting of water, carbon dioxide and nitrogen under the effect of heat at a temperature below 100° C.

14. A domestic appliance, comprising:

a housing;

a drum arranged in the housing, and having at least one agitator;

a process air duct arranged in the housing;

a heater arranged in the housing;

a motor arranged in the housing; and a first fire-prevention medium to extinguish or prevent a spread of a fire, and which is arranged at the process air duct between the heater and the drum;

a second fire-prevention medium to extinguish or prevent a spread of a fire and which is arranged to encapsulate the motor; and a third fire-prevention medium to extinguish or prevent a spread of a fire, and which comprises the at least one agitator.

15. The domestic appliance of claim 14, wherein the first fire-prevention medium, the second fire-prevention medium, and the third fire-prevention medium each comprises a core, a carrier material arranged in the core, a shell which surrounds the core, and an active substance contained in the core which releases at least one member selected from the group consisting of water, carbon dioxide and nitrogen under the effect of heat at a temperature below 100° C.

16. The domestic appliance of claim 15, wherein:

the shell of the first fire-prevention medium comprises a polythene pocket;

the shell of the second fire-prevention medium comprises a plastic molded part; and the shell of the third fire-prevention medium comprises a plastic molded part.

17. The domestic appliance of claim 15, wherein:

the core of the first fire-prevention medium comprises a flexible mat;

the core of the second fire-prevention medium comprises a pair of chambers to accommodate the active substance; and the core of the third fire-prevention medium comprises a chamber to accommodate the active substance.

18. The domestic appliance of claim 15, wherein the carrier material comprises fire-retardant fibers.

19. The domestic appliance of claim 15, wherein the active substance comprises a hydrate.

20. The domestic appliance of claim 19, wherein the hydrate is selected from the group consisting of alum, zeolite, gypsum, and any combination thereof.

* * * * *